US007044680B2

(12) United States Patent
Godbersen et al.

(10) Patent No.: US 7,044,680 B2
(45) **Date of Patent: *May 16, 2006**

(54) METHOD AND APPARATUS FOR CALCULATING AND USING THE PROFILE OF A SURFACE

(75) Inventors: Gary L. Godbersen, Ida Grove, IA (US); James W. Honea, Pleasanton, CA (US)

(73) Assignee: Gomaco Corporation, Ida Grove, IA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 129 days.

(21) Appl. No.: 10/098,981

(22) Filed: Mar. 15, 2002

(65) Prior Publication Data

US 2003/0175077 A1 Sep. 18, 2003

(51) Int. Cl.
*E01C 7/06* (2006.01)

(52) U.S. Cl. ..... 404/75; 404/84.1; 404/118; 404/84.5

(58) Field of Classification Search ..... 404/75, 404/118, 84.5, 84.05, 84.1, 84.8; 73/1.79, 73/1.81, 1.82; 367/13, 127; 342/174
See application file for complete search history.

(56) References Cited

U.S. PATENT DOCUMENTS 4,823,590 A * 4/1989 Kniest et al. ..... 73/1.81
5,101,360 A * 3/1992 Bennett ..... 700/302
5,201,604 A * 4/1993 Ferguson et al. ..... 404/110
5,258,961 A * 11/1993 Sehr et al. ..... 367/96
5,362,177 A * 11/1994 Bowhall et al. ..... 404/84.1
5,393,167 A * 2/1995 Fujita et al. ..... 404/84.1
5,549,412 A * 8/1996 Malone ..... 404/84.1
5,568,992 A * 10/1996 Grembowicz et al. ..... 404/101
5,588,776 A * 12/1996 Swisher et al. ..... 404/72
5,774,374 A 6/1998 Scott et al.
6,035,542 A 3/2000 Woznow et al.
6,161,429 A 12/2000 Marvel et al.
6,161,986 A * 12/2000 Smith et al. ..... 404/75
6,520,715 B1 * 2/2003 Smith ..... 404/75

OTHER PUBLICATIONS 15 pages from a website—p. 1 enitlted Ames Engineering Inc.–dated Jul. 11, 2003.
14 pages, "Testing with the Real Time Profiler on a Fred Carlson Job Jun. 5, 2003"–entitled Ames Engineering dated Oct. 23, 2003.

(Continued)

*Primary Examiner*—Raymond W. Addie
(74) *Attorney, Agent, or Firm*—Sturm & Fix LLP

(57) ABSTRACT

Knowledge of the profile of a road surface—most importantly its defects—is a must to construct an acceptable road surface in this day of high speed traffic. Measurement and calculation of the surface during the process of forming the road—when the road material is still plastic—provides the opportunity to repair unacceptable defects while the road surface material can still be worked. The benefits include a smoother, more durable surface at a lesser cost than methods used on hardened road surfaces. Shown herein is for a method and apparatus for calculating a surface's elevation profile using measurements taken by non-contact devices at a number of locations. Since non-contact sensors are used, elevation profiles of wet concrete can be measured and calculated. Such an apparatus can be mounted on a road paving machine to provide a real time feedback of the surface so corrections to the surface and to the paving machine's operation can be made as required. Alternatively, the method and apparatus can be used just after the pavement is formed but while the pavement is still in a plastic condition so that defects can be corrected before the pavement has hardened.

61 Claims, 10 Drawing Sheets

OTHER PUBLICATIONS

15–page Technical Bulletin dated 1990 entitled Constructing Smooth Concrete Pavements.

14–pages entitled Development of a Non–Contact Pavement Smoothness Monitor for use During Construction by Jeffrey A. Bloom, P.E.—prepared for Annual Meeting dated Jan. 16–20, 1984.

5–pages—entitled Technical Data Sheet—System Four Plus—Slope Sensor 9150P/9152P by TOPCON Laser Systems, Inc.—date at bottom of first page is 2000.

1–page Technical Data Sheet—Sonic Tracker II—9142–0000 Category: Machine Control by Topcon Laser Systems, Inc.—date at bottom of page is May 1999.

6–pages—first page entitled Ames Engineering, Inc.—showing a software version analysis of an Ames Profilograph.

3–pages—first page entitled James Cox & Sons, Inc.—including a photo of a person using a profilograph and a photo of their profilograph.

9 pages—first page entitled CSC Profilair—showing digital readout and information on their profilograph.

12 pages—first page entitled The Face Company—showing graphs and figures of information about their profilograph.

9 pages—first page entitled McCraken—showing a digital information printout report of their profilograph.

5 pages—first page entitled Paveset America—showing graphs, reports and information about their profilograph.

2 pages—first page entitled Rainhart Co.—showing a photo of their profilograph and a graph—also some text information.

3 pages—first page entitled Surface Systems and Instruments—showing graph information and photo of their model of profilograph.

21 pages—first page entitled Ames Engineering, Inc.—showing company information, digital printout information, photographs and text about their products.

10 pages—first page entitled James Cox & Sons, Inc., includes specifications, photos and information about their products.

16–pages—first page entitled CSC Profilair—showing their Digital Profilite 300, including company information, specification information and photos about their products which includes profilograph information.

16 pages—first page entitled The Face Company—including photos,company information, specification information, and text about their products, which includes profilograph information.

3 pages—first page entitled Greenwood Engineering—showing information about their company and products, which includes profilograph information, as shown on their website.

15 pages—first page entitled McCracken—containing information, photos and specifications of their products, which includes profilograph information.

14 pages—first page entitled Paveset America—containing information and photos about their products, which includes profilograph information.

6 pages—first page entitled Rainhart Company—showing company information, photos and information about their products, which includes profilograph information.

6 pages—first page entitled Scientific Instrumentation, Ltd.—with company information, product and text information as shown on their website.

8 pages—first page entitled Surface Systems and Instruments—including company information, profilograph information and photos, as shown on their website.

13 pages—p. 1 entitled Greenwood Engineering—showing profilograph information and photos as shown on their website.

3 pages—p. 86–88 from *Construction Equipment*—dated Mar. 2000—entitled application NOTEBOOK—Profilers Challenge Profilographs.

* cited by examiner

METHOD AND APPARATUS FOR CALCULATING AND USING THE PROFILE OF A SURFACE

TECHNICAL FIELD

This invention relates generally to a method and apparatus for measuring the surface elevation profile of a newly formed surface. More specifically, it relates to a system utilizing a plurality of non-contact, sensors (such as ultrasonic or laser sensors) to measure the distance between the sensor and the concrete surface, then determining the average slope of the surface between pairs of sensors. From a known initial elevation profile (in the neighborhood of a starting position), the profile of the entire surface can be calculated and utilized by the finishing equipment to remedy faults before the road material has hardened. This invention could be applied to other surfaces measured for smoothness and is not just useful for road surfaces.

BACKGROUND ART

Present-day method of finishing concrete slabs such as are used for road surfaces, utilize a slip forming machine to form the edges, screed and trowel the surface, as well as inserting some of the structural steel. The road is finished, and the concrete permitted to cure before the final testing is done to determine if the surface meets smoothness requirements.

From an early date, wheeled vehicles, called profilographs, have been used to measure the smoothness of a cured road surface, hard enough to support the wheels of the profilograph. Some commonly used varieties of profilographs are the California Profilograph and the Rainhart Profilograph.

The need for a profiler using non-contact sensors was recognized some years ago. A paper entitled *Development of a Non-contact Pavement Smoothness Monitor for Use During Construction* was prepared for presentation at the 1984 Annual Meeting of the Transportation Research Board by Jeffrey A. Bloom. Described in this paper is a system for determining an aspect of road smoothness using non-contact ultrasonic sensors at four locations arranged along the road surface (parallel to the direction traveled by motor vehicles). The data from the sensors are used to calculate a quantity called Asymmetric Chord Offset (ACO). Using any three sets of sensors, a chord line can be envisioned between the points at which the outer two sets of sensors reflect off the road surface. The set of sensors in between these outer sets of sensors measures a distance between the road surface and the sensor set. The distance between the point on the road surface where this middle signal reflects and the point on the chord line directly below these middle sensor sets is the ACO for those three sets of sensors. Data are taken every three inches (in a direction parallel to traffic). Multiple sets of these sensors are used to make simultaneous measurements at a plurality of locations across the road surface.

With this method, only relative measurements are taken. No absolute datum is compared to, and the locations of the individual sensors relative to the road surface vary as the device moves forward. The slope of the beam on which the sensors are mounted is not measured. Therefore, an elevation profile of the road surface is not possible. Only values of ACO are calculated.

The bank of sensors disclosed in the above mentioned paper are mounted on a four-wheeled vehicle (called a "bridge"), made to straddle the road (the wheels run outside the concrete and forms, if any). Therefore, the operation performed by the apparatus is strictly a measuring and recording operation. Modifications to the surface profile, based on the findings of this measurement, are performed by separate machinery after the measuring step. Adjustments to the road finishing machinery may not be possible in real time. Furthermore, the Jeffrey A. Bloom bridge is a rather large apparatus, making transport difficult.

For the reasons mentioned, there is a need for a method to measure the elevation profile of the surface of a road using non-contact sensors as a device independent of a paving machine. Further need is for a device that can be mounted on a slip form paving machine (or other type of road-surface finishing device), permitting immediate correction to unacceptable surface profiles, as well as adjustments to the finishing machine's operation in real time.

DISCLOSURE OF THE INVENTION

A purpose of this invention is to improve upon the prior art by providing a method for measurement of a road-surface elevation profile while the road material (such as concrete or asphalt) is still workable. Measures can then be taken to repair serious elevation faults.

For the following description, let the x axis be oriented in a direction parallel to motor vehicle travel on the road surface.

For the present invention, an elevation profile of the road surface is constructed using a method called the "Incremental Slope Method" (ISM). ISM constructs a road-surface elevation profile by measuring the slope between successive pairs of points (oriented such that a line drawn between these points and the x axis define a plane) on the road surface which are separated by a known distance. Using a known absolute elevation at one point, it is possible to calculate the absolute elevation of the other point as $$y_1=y_0+md_x$$

where $y_0$ and $y_1$ are the elevations of the points at $x_0$ and $x_1$, respectively, m is the slope between points 0 and 1, and $d_x$ is the known horizontal distance between the two points.

By moving the two points in the x-direction a known distance less than $d_x$, the process can be repeated and the road-surface elevation profile can be constructed in as fine an increment as is desired. This points out the need for the a priori knowledge (or estimate) of the profile of the road surface in the region, $x_0 \leqq x \leqq x_0+d_x$. Then, on $x_0+d_x<x$, absolute elevations can be calculated, and the road-surface profile constructed in as fine a detail as desired (within the accuracy of the sensors and other equipment).

BEST MODES FOR CARRYING OUT THE INVENTION

Figure 1:
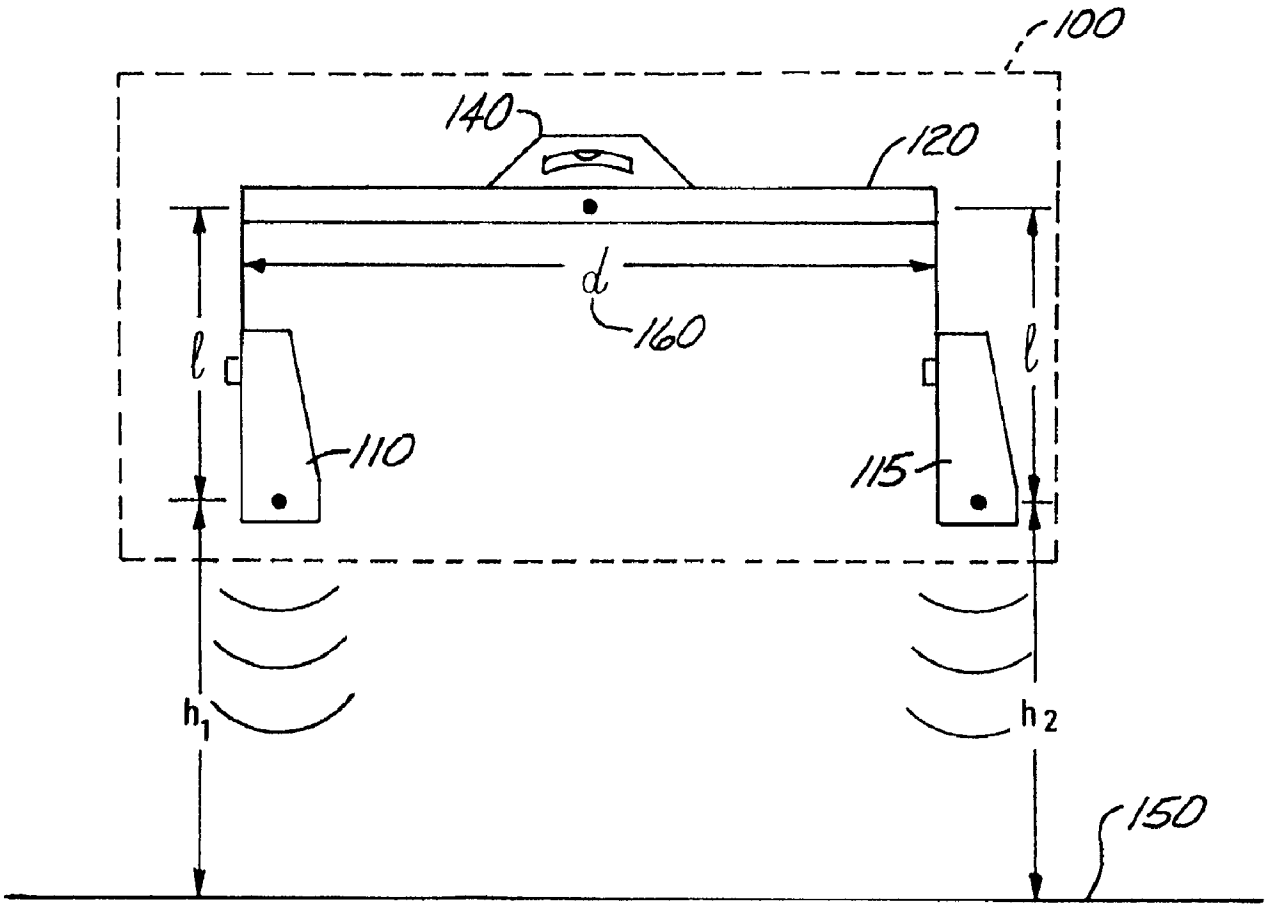
FIG. 1 shows the sensor assembly.

The incremental slope method is used to construct a road-surface elevation profile by measuring the slope between successive pairs of points on the road surface which are separated by a calculable increment. FIG. 1 provides a schematic of the sensor assembly 100, which comprises two sets of non-contacting elevation sensors 110 and 115 (for example, Topcon Laser Systems, Inc. sells a model called "Sonic Tracker II" 9142-0000) mounted on a beam 120 a fixed distance, d 130 apart, along with a slope sensor 140 which measures the slope of the beam in the direction of travel. (For example, the slope sensor might be a "System Four Plus Slope Sensor" 9150P/9152P from Topcon Laser Systems, Inc.) The elevation sensors could be any non-contacting type such as ultrasonic or laser sensors. Elevation sensor set 115 is ahead of elevation sensor set 110 in a direction of travel the assembly will travel. The elevation profile of road surface 150 to the left (as oriented in FIG. 1) of sensor set 115 would be known (or estimated).

A typical set of elevation sensors (such as 110) comprises three sensors which combine their efforts to provide the necessary and accurate information to calculate the distance the road surface 150 lies from the sensor set at a point defined by the intersection of the surface 150 and a line drawn through the center of the sensor set 110 perpendicular to the beam 120.

Calculation of the road surface 150 elevation can be carried out regardless of the angle of the beam relative to the horizontal.

For the following analysis, the following definitions are used (see FIG. 2):

- x is the coordinate used on the abscissa, lying in a horizontal orientation. Note that this coordinate will curve with the road, but always lies in a horizontal plane.
- y is the coordinate used on the ordinate, oriented in the vertical direction.

Road Elevation Profile

Figure 2:
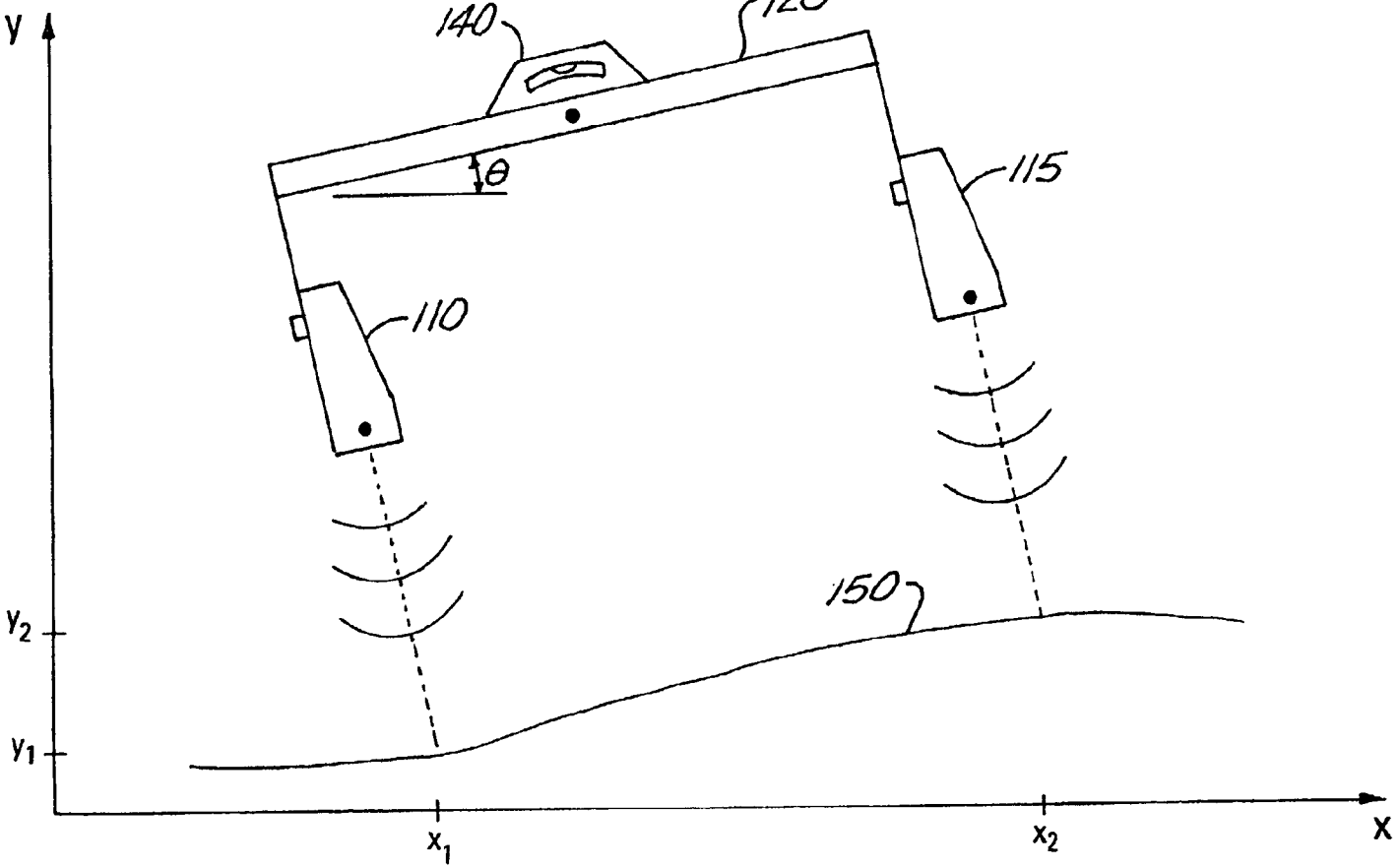
FIG. 2 shows the sensor assembly in operation at angle, θ, and the road surface of interest.

To determine the road surface elevation profile, we begin with a known or estimated road surface elevation profile throughout an initial increment, $x_0 \leqq x < x_0 + d \cos \theta^0$ where $x_0$ is an arbitrary starting coordinate, d is the beam length 160, and $\theta^0$ is the initial angle of the beam 120 measured from the horizontal as shown in FIG. 2. Initial angle $\theta^0$ is as measured by slope sensor 140.

Figure 3:
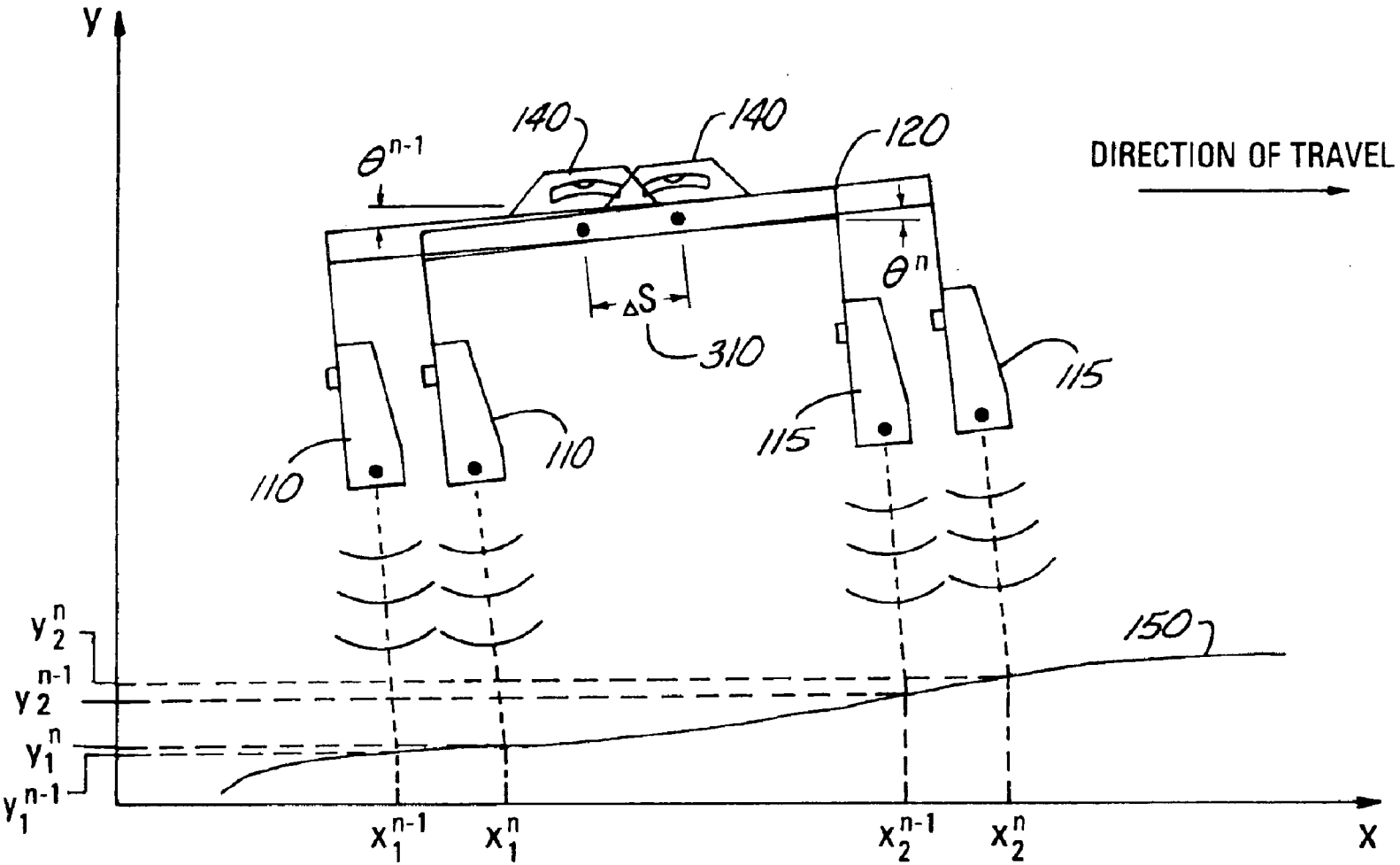
FIG. 3 shows the sensor assembly in operation in an initial location and having translated a distance in the direction of travel.

The sensor assembly 100 is moved in the direction of travel (from left to right according to FIGS. 1 and 2) an increment having a horizontal component less than or equal to d cos $\theta^0$. This increment is denoted Δs 310 as shown in FIG. 3, and might be equal to two inches, for example. A sensor (610 of FIG. 6 or 710 of FIG. 7) to measure the distance of travel is a required component to this invention. At this point, rear sensor set 110 senses the road surface 150 at a location for which the elevation is known (or assumed). Forward sensor set 115 senses the surface 150 at a new location—one for which the elevation has not been calculated.

The elevation of the road surface 150 as determined by the forward sensor set 115 is calculated using the known elevation at the point sensed by rear sensor set 110. The method is carried out by calculating the vertical distance from the road surface to the rear end of beam 120, then the vertical distance from the rear end of beam 120 to the forward end, then the vertical distance from the forward end of beam 120 to the road surface sensed by the forward sensor 115. The orientation of the sensing apparatus is shown in FIG. 2. In practice, the calculation is as follows:

$$y_2 = y_1 + (h_1 - h_2)\cos\theta + d\sin\theta$$

where the subscript 1 is for the rear sensor, and the subscript 2 is for the forward sensor. The x (horizontal) coordinate for the forward sensor is also required for later reference. This is found by:

$$x_2 = x_1 + (h_2 - h_1)\sin\theta + d\cos\theta$$

The coordinates $(x_1,y_1)$ and $(x_2,y_2)$ are depicted in FIG. 2. However, the instantaneous x coordinate of the rear sensor is not immediately known. This must be calculated as follows:

$$x_1^n = x_1^{n-1} + \Delta s^n \cos\left[\frac{1}{2}(\theta^{n-1} + \theta^n)\right] - (h_1^{n-1} + l)\sin\theta^{n-1} + (h_1^n + l)\sin\theta^n + \frac{1}{2}d(\cos\theta^{n-1} - \cos\theta^{n-1})$$

where the superscript n−1 refers to the previous location of beam 120, while superscript n is for the present location of beam 120.

The coordinates $(x_2,y_2)$ are recorded, the beam 120 translated another increment, Δs 310, and the process repeated until the end of the surface of interest is reached. Interpolation, using well known formulas such as a polynomial spline fit of the data, can be performed to estimate the coordinates of the road surface 150 between measured points. From the recorded data, several established roughness indices can be calculated and outputted. The data can also be displayed as traces similar to those used in the industry, presently.

Figure 4:
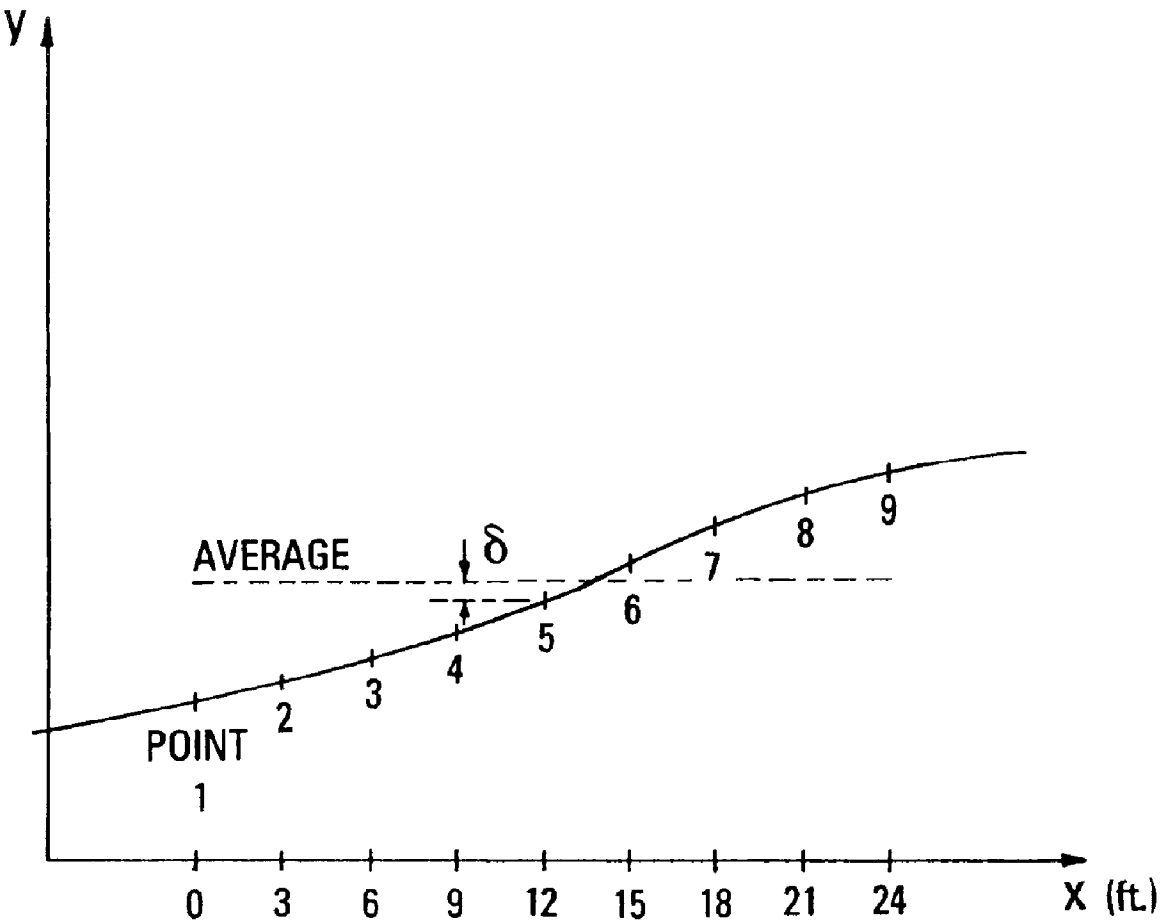
FIG. 4 shows a road surface marked off in known horizontal increments and an average elevation.

A result could be calculated, for instance, in a fashion analogous to the measurement made by a twenty five foot, eight wheeled profilograph. See FIG. 4 for this part of the analysis. Using the recorded (x,y) data, nine points three feet apart (for instance) are selected or calculated by interpolation. An arithmetic average is taken of eight of the elevations (y values)—all except the elevation for point 5 ($y_5$). Then the vertical distance between point 5 and the average is taken as the profilograph output for point 5 (at $x_5$).

Using interpolation between discrete measurement points, a continuous profilograph output can be generated.

Translation

Figure 6:
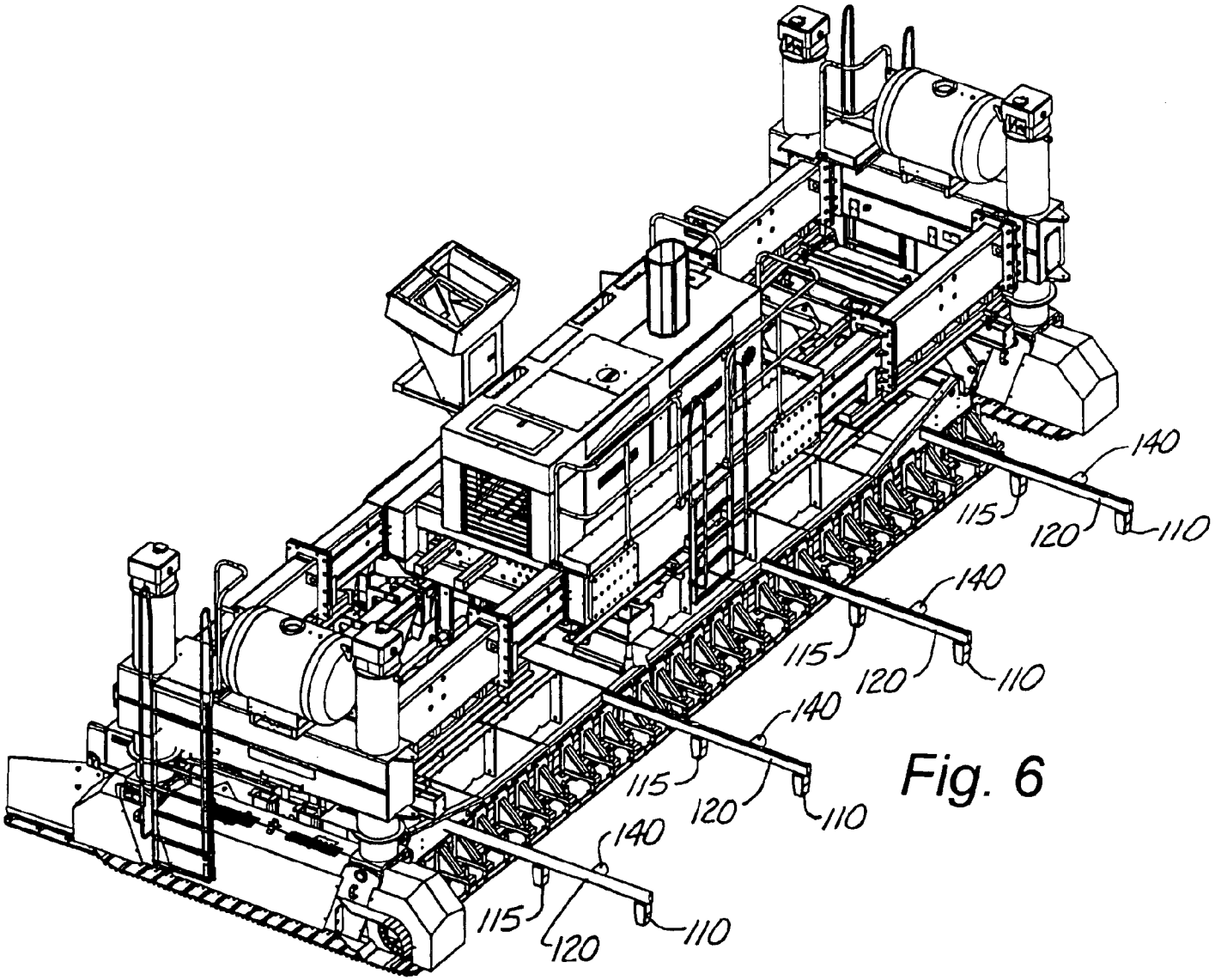
FIG. 6 shows four sensor assemblies mounted on the back of a two lane slip form paving machine, but wider or narrower machines can be used with more or less sensor assemblies.

The translating of the sensor assembly 100 can be carried out in several ways, and the present invention is not to be limited to a particular mode of translation. Commonly, a plurality of sensor assemblies 100 will be mounted on the rear of a road paving machine, such as a slip form paver as depicted in FIG. 6. This permits the adjustment of the paving machine as faults in the smoothness are detected, as well as the repair of the road surface while the road surface material is still sufficiently plastic to permit working with it.

Figure 7:
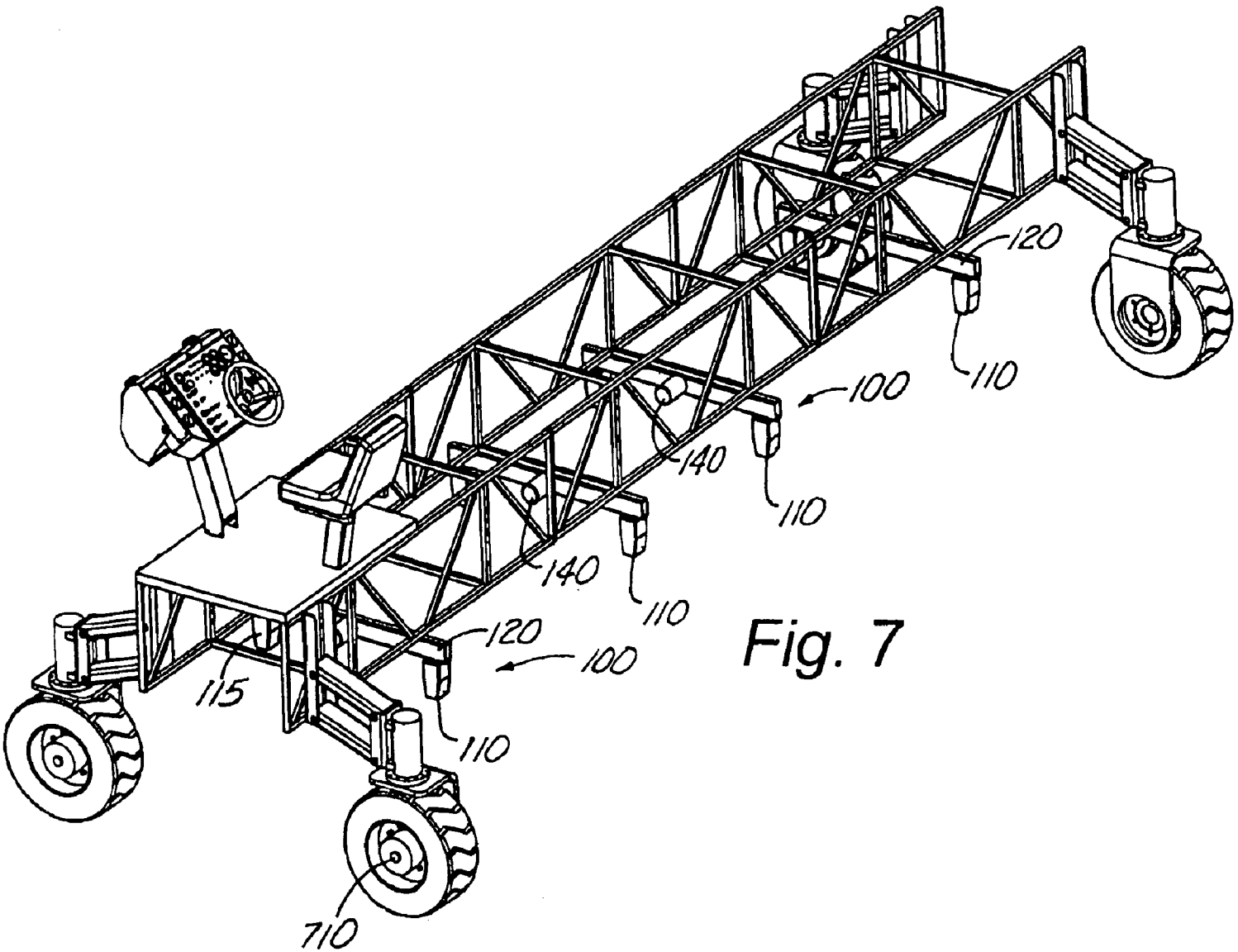
FIG. 7 shows four sensor assemblies mounted on a wheeled vehicle dedicated to making road-surface profile measurements.

Another common mode of translation is shown in FIG. 7. Here a dedicated rig for the purpose of determining the elevation profile of the road surface is employed. Again, a plurality of sensor assemblies 100 are in use to provide a profile of all the important parts of the road surface. Important paths along the road surface would typically comprise the paths motor vehicle tires will follow when the road is open for general, public use.

Initial Elevation Profile

As stated, above, the elevation profile a portion of the surface must be known, estimated, or assumed on the interval $x_0 \leqq x < x_0 + d \cos \theta^0$. This information can be obtained in a variety of ways.

One of the ways the surface can be obtained in this region is to assume the surface is flat—that is, a straight line between $x=x_0$ and $x=x_0+d \cos \theta^0$. The difference between the actual elevation at each point and the assumed surface will reappear as errors in the elevation (y values) on each interval following the initial one. There are two options for improving the resulting surface estimate:

1. Remove the resulting errors with a low-pass filter. By passing the entire elevation profile through a low-pass filter algorithm with a cutoff wavelength longer than d, the error would be diminished.

2. Attempt to remove the error by determining a Taylor Series or Fourier Series most highly correlated to the y(x) values in every interval of the surface profile.

Another of the ways the initial surface can be obtained in this region is to calibrate the measurement by laying a known flat plate having a length greater than d so it lies under both sensor sets at the initial location. Deviations from this flat plate are measured.

Figure 8:
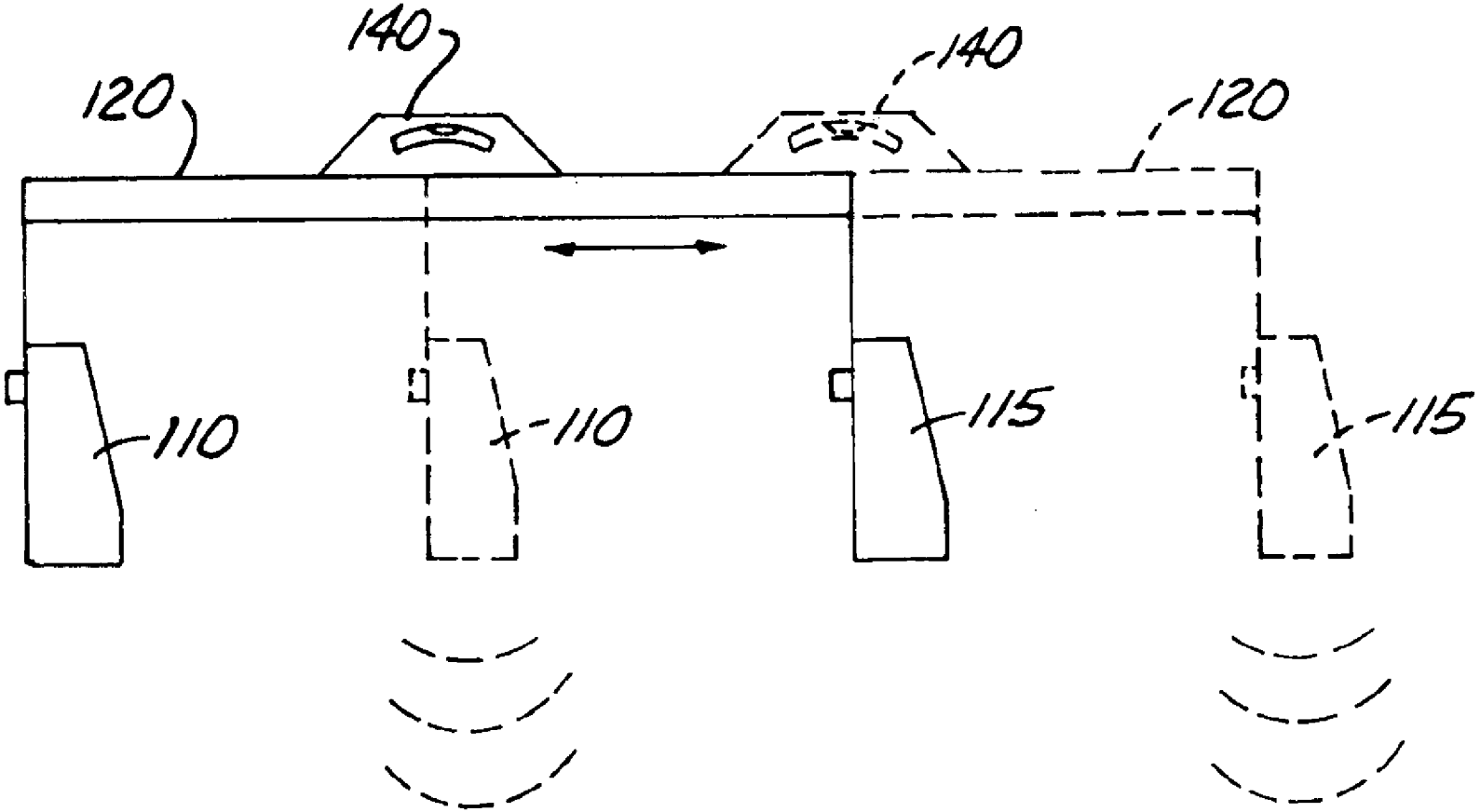
FIG. 8 shows the sensor assembly translated without moving the vehicle on which it is mounted to determine an initial road-surface elevation profile.
Figure 9:
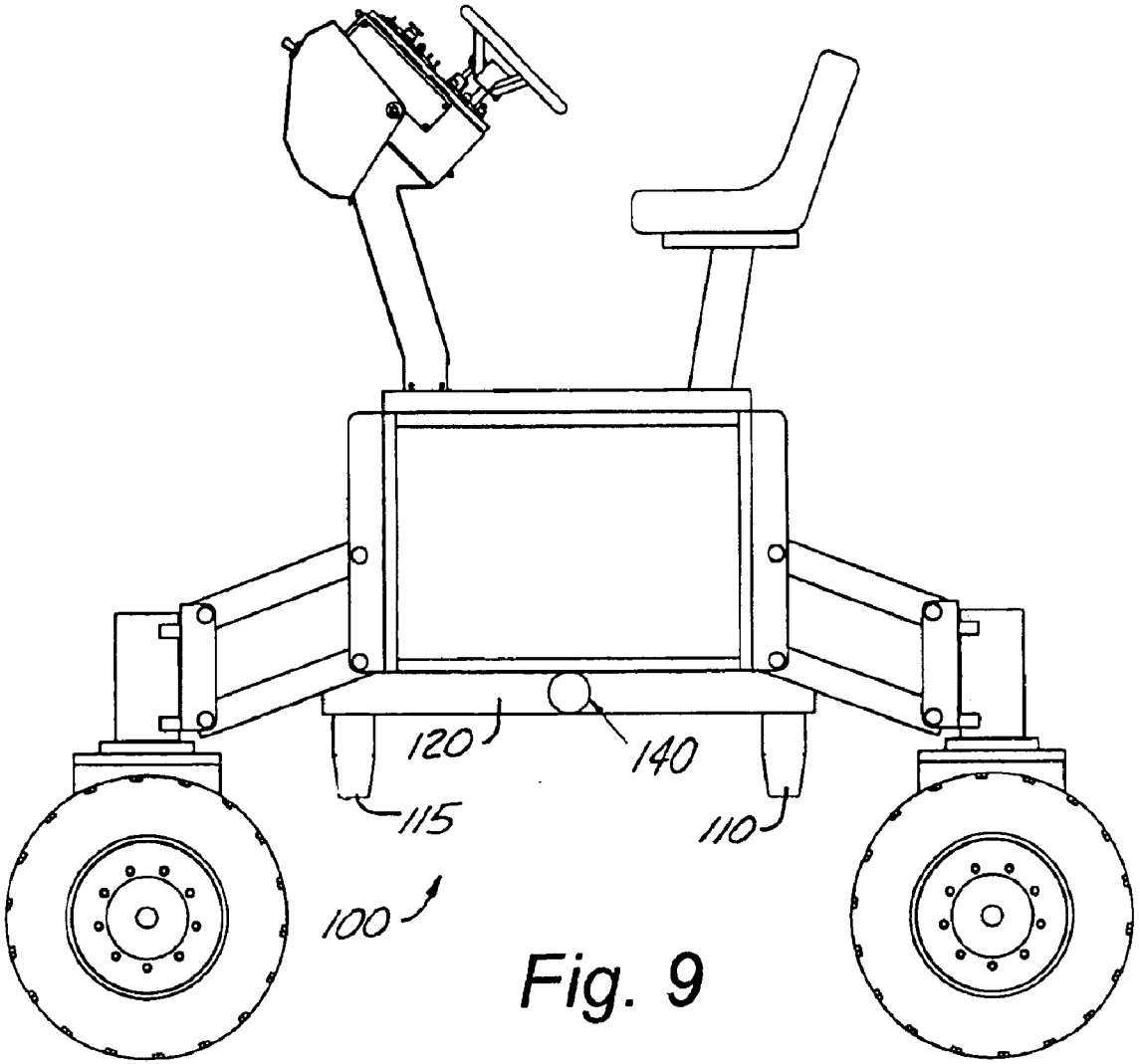
FIG. 9 is a side elevational view of the FIG. 7 apparatus.
Figure 10:
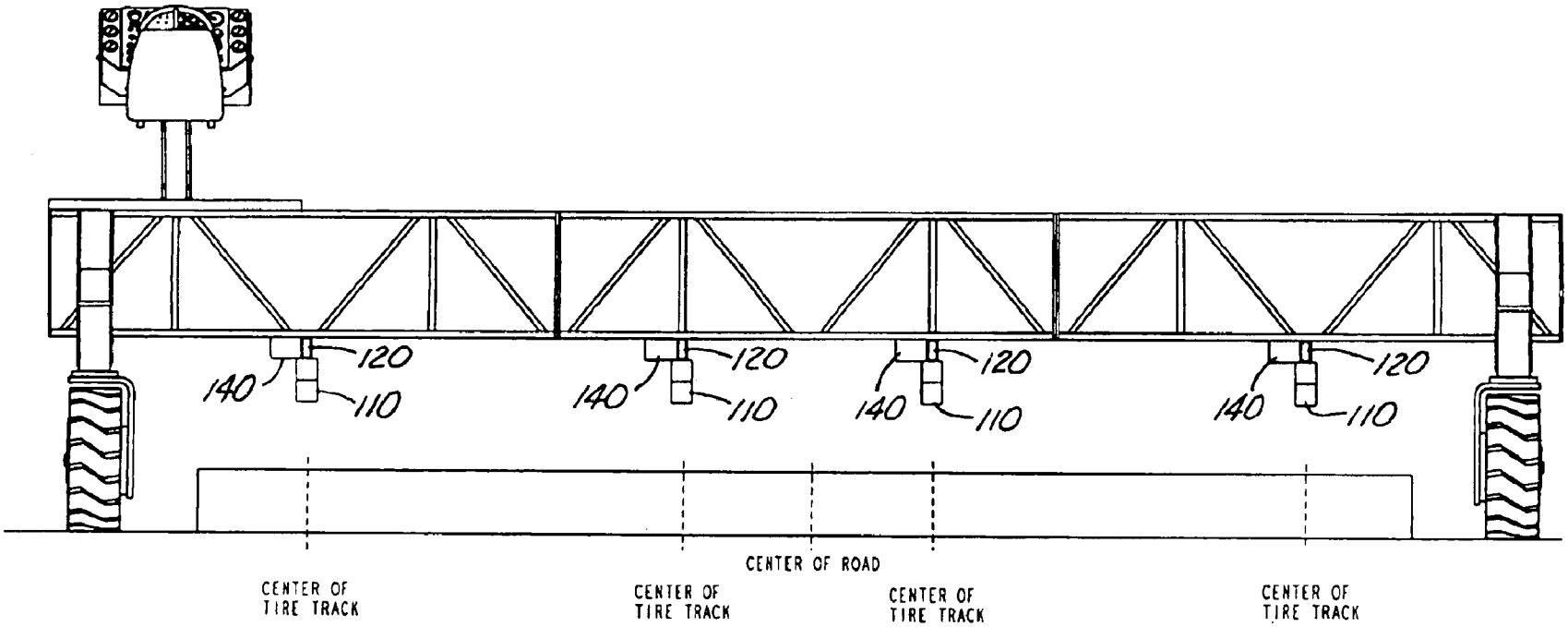
FIG. 10 is a rear elevational view of the FIG. 7 apparatus.

Still another alternative for obtaining an initial surface elevation profile is depicted in FIG. 8. In this alternative, translation of the sensor assembly occurs over a distance at least $d \cos \theta^0$ without movement of the vehicle on which the assembly is mounted. This way, the angle, θ, is unchanging throughout the process. An additional translation sensor (610 FIG. 6 and 710 FIG. 7) to measure the distance traversed must be included in the apparatus. For this approach, the required distance of translation would only be ½ $d \cos \theta^0$ because both sensors may be utilized. To calculate the coordinates of the rear sensor, the following equations are used $$x_1^n 32\ x_1^{n-1} + \Delta s^n \cos \theta$$

$$y_1^n 32\ y_1^{n-1} + \Delta s^n \sin \theta + (h_1^n - h_2^n) \cos \theta$$

where Δs is measured by the additional translation sensor. The superscripts are defined as above. The coordinates for the front sensor are given as $$x_2^n 32\ x_1^n + d \cos \theta$$

$$y_2^n 32\ y_1^n + (h_1^n 31\ h_2^n) \cos \theta + d \sin \theta$$

Figure 5:
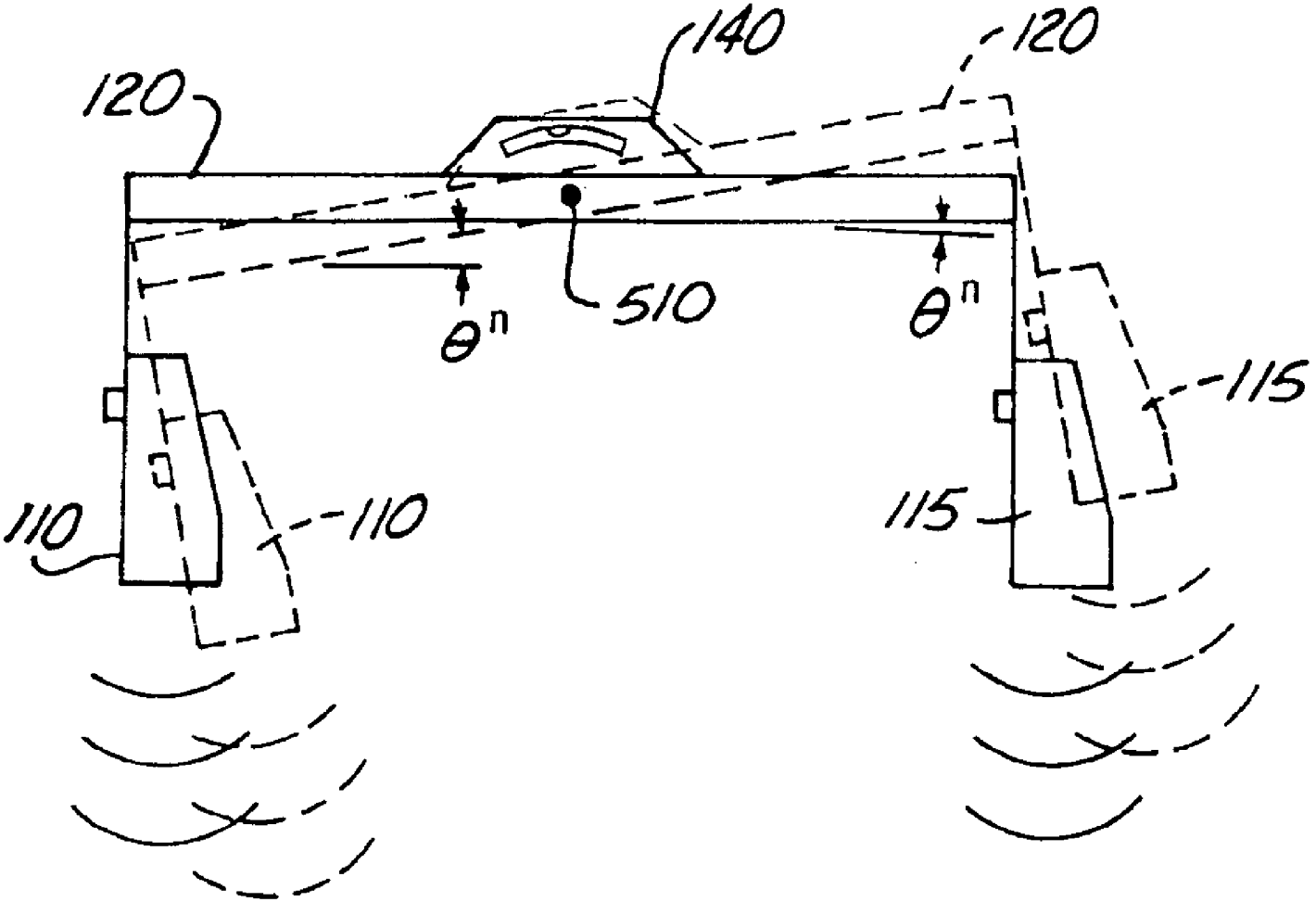
FIG. 5 shows the sensor assembly having rotated without translating.

Finally, the beam 120 can be rotated parallel to a (roughly) vertical plane about its center (the actual point of rotation is arbitrary, but for the following analysis, the center is the assumed point of rotation). No translation is to take place during this process. FIG. 5 is a depiction of this method. Let 0 to be the initial orientation of the beam, and 1, 2, . . . , n−1, n, . . . , N to be successive angles at which discrete measurements are taken.

To determine the rear sensor set's final location, $x_1^1$, relative to its initial position $x_1^0$, we calculate the horizontal distance from the initial location to the beam's center, then back to the final location. Referring to FIG. 5 for nomenclature, the location of $x_1^1$, is calculated as:

$$x_1^1 = x_1^0 - (h_1^0 + l)\sin\theta^0 + (h_1^1 + l)\sin\theta^1 + \frac{1}{2}d(\cos\theta^0 - \cos\theta^1)$$

The corresponding y location $y_1^1$, relative to the initial y location $y_1^0$, is determined calculating the vertical distance from the initial location to the beam's center, then back to the final location, thus:

$$y_1^1 = y_1^0 + (h_1^0 + l)\cos\theta^0 - (h_1^1 + l)\cos\theta^1 + \frac{1}{2}d(\sin\theta^0 - \sin\theta^1)$$

At the same time, the rear sensor 110 can be measuring the road surface as the beam is rotated. The coordinates when $\theta=\theta_0$ are calculated thus:

$$x_2^0 = x_1^0 + (h_2^0 - h_1^0)\sin \theta^0 + d \cos \theta^0$$

$$y_2^0 = y_1^0 + (h_1^0 - h_2^0)\cos \theta^0 + d \sin \theta^0$$

Then, as the beam is rotated, the coordinates from both sensors are calculated as:

$$x_1^n = x_1^{n-1} + (h_1^{n-1} + l)\sin\theta^{n-1} + (h_1^n + l)\sin\theta^n + \frac{1}{2}d(\cos\theta^{n-1} - \cos\theta^n)$$

$$x_2^n = x_1^n + (h_2^n - h_1^n)\sin\theta^n + d\cos\theta^n$$

$$y_1^n = y_1^{n-1} + (h_1^{n-1} + l)\cos\theta^{n-1} - (h_1^n + l)\cos\theta^n + \frac{1}{2}d(\sin\theta^{n-1} - \sin\theta^n)$$

$$y_2^n = y_1^n + (h_1^n - h_2^n)\cos\theta^n + d\sin\theta^n$$

The present invention is not limited to use on concrete paved roads, or to the concrete forming process. The method and apparatus described here is useful for any road surface material, including concrete and asphalt. This invention could be applied to other surfaces measured for smoothness and is not just useful for road surfaces.

Obviously, many other modifications and variations of the present invention are possible in light of the above teachings. It is, therefore, to be understood that within the scope of the appended claims, the invention may be practiced otherwise than as specifically described.

We claim:

1. A method for measuring a surface elevation profile of a paved surface, after a paving machine has passed completely over the paved surface, using a measuring device comprising a plurality of non-contact, wave reflecting sensors, said sensors being arranged one in front of the other in a direction of travel a known distance apart, and a slope sensor for measuring an angle of a line connecting said non-contact sensors with respect to a datum, the method comprising:

(a) placing a first one of said plurality of non-contact, wave reflecting sensors in front of a second one of said plurality of non-contact, wave reflecting sensors a known distance apart in a direction of travel and above the paved surface over which the paving machine has completely passed over;

(b) using said first and second sensors of said plurality of non-contact wave reflecting sensors to sense a distance between each of said first and second non-contact sensors and measured locations on the paved surface;

(c) using the slope sensor to measure the angle of the line connecting said first and second non-contact sensors with respect to the datum;

(d) using the known distances between the first and second non-contact sensors in the direction of travel and the angle measured by the slope sensor to calculate a relative elevation between the measured locations of the paved surface; and (e) determining a need to further modify the paved surface elevation profile based on a plurality of the calculated relative elevation data points.

2. The method of claim 1 including adjusting the paving machine's operation based on the relative elevation calculated.

3. The method of claim 1 including using the relative elevation calculated to determine elevations relative to a single datum.

4. The method of claim 1 including measuring, with the slope sensor, an angle, θ, relative to a horizontal, of a line drawn between the first and second non-contact sensors, and calculating the relative elevation as $y_2=y_1(h_1-h_2)\cos\theta+d\sin\theta$ where $y_1$ and $y_2$ are elevations for two surface locations, $h_1$ and $h_2$ are the measured distances between each of said first and second non-contact sensors and the surface, and d is the known distance between non-contact sensors.

5. The method of claim 1 including mounting a plurality of said first and second non-contact, wave reflecting sensors and slope sensors in parallel and using said plurality of first and second non-contact, wave reflecting sensors and slope sensors simultaneously to obtain surface elevation profiles along a plurality of paths on said surface.

6. The method of claim 1 wherein the measuring device makes no contact with the paved surface.

7. The method of claim 1 wherein the steps of using said first and second non-contact sensors and using the slope sensor are carried out during a paving operation while said road surface is in a plastic condition.

8. The method of claim 7 including mounting said measuring device on a paving machine.

9. The method of claim 8 wherein the measurement device also comprises a distance translated sensor and wherein the method additionally comprises measuring an initial surface profile increment by translating the measurement device in measured increments while keeping said paving machine stationary.

10. The method of claim 9 additionally comprising calculating coordinates of the surface profile associated with a rear non-contact sensor as $$x_1^n=x_1^{n-1}+\Delta s^n\cos\theta$$

$$y_1^n=y_1^{n-1}+\Delta s^n\sin\theta+(h_1^n-h_2^n)\cos\theta$$

where n denotes values from a present sensor assembly location, n1 denotes values from a previous location, Δs is a distance traveled, θ is the angle of a line connecting said first and second non-contact, wave reflecting sensors, and h is the distance between each of said first and second non-contact, wave reflecting sensors and the surface; and calculating coordinates of the surface profile associated with a front non-contact sensor as $$x_2^n=x_1^n+d\cos\theta$$

$$y_2^n=y_1^n+d\sin\theta+(h_1^n-h_2^n)\cos\theta$$

where d is a distance between the first and second non-contact, wave reflecting sensors.

11. The method of claim 1 wherein said measuring is done following a paving operation while said road surface is in a plastic condition.

12. The method of claim 11 including mounting said measuring device on a wheeled vehicle dedicated to making such measurements.

13. The method of claim 12 wherein the measurement device also comprises a distance translated sensor and wherein the method additionally comprises measuring an initial surface profile increment by translating the measurement device while keeping said wheeled vehicle dedicated to making such measurements stationary.

14. The method of claim 1 wherein the measuring device also comprises a distance-traveled sensor, the method additionally comprising the step of using said distance-traveled sensor for calculating a horizontal location, x, of each of the measured locations.

15. The method of claim 14 including calculating said horizontal location relative to a previous location of said measuring device as:

$$x^n = x^{n-1} + \Delta s^n\cos\left[\frac{1}{2}(\theta^{n-1}+\theta^n)\right] - (h^{n-1}+l)\sin\theta^{n-1} + (h^n+l)\sin\theta^n + \frac{1}{2}d(\cos\theta^{n-1}-\cos\theta^n)$$

where n represents values for a most recent location, n−1 represents values from a previous location, x is a horizontal location, Δs is a distance traveled in a direction of travel, θ is an angle from a horizontal of a line connecting the first and second non-contact, wave reflecting sensors, l, is a length measured from the non-contact sensor to a beam on which said non-contact sensor is mounted, h is the distance between the first and second non-contact, wave reflecting sensors and the surface, and d is the known distance between the first and second non-contact, wave reflecting sensors.

16. The method of claim 14 additionally comprising taking a plurality of measurements at multiple horizontal locations, x, the method comprising the additional steps of:

(a) using said first and second non-contact sensors to sense a distance between each of said first and second non-contact sensors and a plurality of measured locations on the paved surface; and (b) using the slope sensor to measure an angle between said first and second non-contact sensors at a plurality of horizontal locations, x.

17. The method of claim 16 including using said plurality of measurements to construct the surface elevation profile.

18. The method of claim 17 including constructing said surface profile by curve fitting said plurality of measurements, said curve fit not a single straight line.

19. The method of claim 18 wherein fitting the curve comprises calculating a spline fit.

20. The method of claim 1 including knowing, a priori, an initial increment of the surface elevation profile.

21. The method of claim 20 including calibrating the known initial surface profile increment using a flat plate at least as long as the initial increment and measuring the profile relative to the flat plate.

22. The method of claim 20 including estimating said known initial surface profile increment using a curve fit.

23. The method of claim 22 including estimating said known initial surface profile increment using a Taylor Series curve fit.

24. The method of claim 22 including estimating said known initial surface profile increment using a Fourier Series curve fit.

25. The method of claim 20 additionally comprising measuring the known initial surface profile increment by rotating the measurement device such that one non-contact sensor is lowered relative to another while measurements are taken.

26. The method of claim 25 additionally comprising calculating coordinates of the surface profile associated with a rear non-contact sensor as $$x_1^n = x_1^{n-1} + (h_1^{n-1} + l)\sin\theta^{n-1} + (h_1^n + l)\sin\theta^n + \frac{1}{2}d(\cos\theta^{n-1} - \cos\theta^n)$$

$$y_1^n = y_1^{n-1} + (h_1^{n-1} + l)\cos\theta^{n-1} + (h_1^n + l)\cos\theta^n + \frac{1}{2}d(\cos\theta^{n-1} - \cos\theta^n)$$

and calculating coordinates of the surface profile associated with a front non-contact sensor as $$x_2^n = x_1^n + (h_2^n - h_1^n)\sin\theta^n d\cos\theta^n$$

$$y_2^n = y_1^n + (h_2^n - h_1^n)\cos\theta^n d\sin\theta^n$$

where n denotes values from a present sensor assembly location, n−1 denotes values from a previous location, Δs is a distance traveled, θ is the angle of a line connecting said first and second non-contact, wave reflecting sensors, and h is the distance between the first and second non-contact, wave reflecting sensors and the surface, l is a distance between the first and second non-contact, wave reflective sensors and a beam on which the first and second non-contact, wave reflective sensors are mounted, and d is the distance between the first and second non-contact, wave reflective sensors.

27. The method of claim 1 wherein the paved surface comprises uncured paving material.

28. The method of claim 27 wherein the uncured paving material is concrete.

29. The method of claim 28 wherein the step of modifying the paved surface elevation profile is carried out before the uncured paving material has cured.

30. An apparatus for measuring a surface elevation profile of a paved surface, said paved surface having been passed over completely by a paving machine, the apparatus comprising:

(a) a plurality of non-contact, wave reflecting sensors arranged one in front of the other in a direction of travel a known distance apart, the sensors used for sensing a distance between each of said non-contact, wave reflecting sensors and the paved surface, said paved surface having been passed over completely by the paving machine;

(b) a slope sensor for measuring an angle of a line connecting two of the non-contact sensing means with respect to a datum;

(c) a first calculation function using the distances between each of the non-contact, wave reflective sensors and the paved surface, the known distance between the non-contact sensors in the direction of travel, and the angle measured by the slope sensor to calculate a relative elevation between measured locations of the paved surface; and (d) means for modifying the paved surface elevation profile based on a plurality of the relative elevation data points calculated.

31. The apparatus of claim 30 additionally comprising means for supporting said apparatus wherein the apparatus makes no contact with the paved surface.

32. The apparatus of claim 30 including a calculation function to use the calculated relative elevation to determine elevations relative to a single datum.

33. The apparatus of claim 30 wherein the slope sensor indicates an angle, θ, relative to a horizontal, of a line drawn between two non-contact sensors; the apparatus comprising a calculation function to calculate the relative elevation as $y_2=y_1+(h_1-h_2)\cos\theta+d\sin\theta$ where $y_1$ and $y_2$ are elevations for two surface locations, $h_1$ and $h_2$ are the distances between each of said non-contact sensors and the surface, and d is the known distance between non-contact sensors.

34. The apparatus of claim 30 including means to make adjustments to the paving machine's operation based on a plurality of the relative elevation data points calculated.

35. The apparatus of claim 30 including means to carry out said sensing and measuring immediately following the complete passing of the paving machine while said road surface is in a plastic condition.

36. The apparatus of claim 35 including a slip forming paving machine, said measuring device being attached to the slip forming paving machine.

37. The apparatus of claim 36 also comprising an actuator for linearly translating the sensing means wherein an initial paved surface profile increment is measured by translating the measurement device while keeping said paving machine stationary.

38. The apparatus of claim 37 also comprising a calculation function for calculating coordinates of the surface profile associated with a rear non-contact sensor as $$x_1^n = x_1^{n-1} + \Delta s^n \cos\theta$$

$$y_1^n = y_1^{n-1} + \Delta s^n \sin\theta + (h_1^n - h_2^n)\cos\theta$$

and coordinates of the surface profile associated with a front non-contact sensor as $$x_2^n = x_1^n + d\cos\theta$$

$$y_2^n = y_1^n + d\sin\theta + (h_1^n - h_2^n)\cos\theta$$

39. The apparatus of claim 30 including means to carry out said sensing and measurements following the complete passing of the paving machine while said road surface is in a plastic condition.

40. The apparatus of claim 39 including a wheeled vehicle dedicated to making such measurements, said plurality of non-contact, wave reflecting sensors and slope sensor mounted on the wheeled vehicle.

41. The apparatus of claim 40 also comprising an actuator for linearly translating the sensing means wherein an initial paved surface profile increment is measured by translating the measurement device while keeping said wheeled vehicle dedicated to making such measurements stationary.

42. The apparatus of claim 41 also comprising a calculation function for calculating coordinates of the surface profile associated with a rear non-contact sensor as $$x_1^n = x_1^{n-1} + \Delta s^n \cos\theta$$

$$y_1^n = y_1^{n-1} + \Delta s^n \sin\theta + (h_1^n - h_2^n)\cos\theta$$

and coordinates of the surface profile associated with a front non-contact sensor as $$x_2^n = x_1^n + d\cos\theta$$

$$y_2^n = y_1^n + d\sin\theta + (h_1^n - h_2^n)\cos\theta$$

43. The apparatus of claim 30 wherein the measuring device also comprises a sensor for measuring distance-traveled.

44. The apparatus of claim 43 also comprising a calculation function for calculating a horizontal location relative to a previous location of said measuring device as:

$$x^n = x^{n-1} + \Delta s^n \cos\left[\frac{1}{2}(\theta^{n-1} + \theta^n)\right] - (h^{n-1} + l)\sin\theta^{n-1} + (h^n + l)\sin\theta^n + \frac{1}{2}d(\cos\theta^{n-1} - \cos\theta^n)$$

where n represents values for a most recent location, x is a horizontal location, Δs is a distance traveled in a direction of travel, θ is an angle from a horizontal of a line connecting two non-contact sensors, l, is a length measured from the non-contact sensor to a beam on which said non-contact sensor is mounted, h is the distance between the non-contact sensors and the surface, and d is the known distance between non-contact sensors.

45. The apparatus of claim 43 also comprising means to take a plurality of measurements at multiple horizontal locations, x.

46. The apparatus of claim 45 also comprising a calculation function to calculate a surface elevation profile using said plurality of measurements.

47. The apparatus of claim 46 also comprising a calculation function to calculate said surface profile by curve fitting said plurality of measurements, said curve fit not a single straight line.

48. The apparatus of claim 30 additionally comprising means for supporting said apparatus wherein the apparatus makes no contact with the paved surface.

49. The apparatus of claim 47 the calculation function is a calculation function for fitting the curve with a spline fit.

50. The apparatus of claim 30 including means to determine an initial increment of the surface profile.

51. The apparatus of claim 50 comprising:

(a) a flat plate to calibrate the known initial surface profile increment at least as long as the initial increment; and (b) means for measuring the profile relative to the flat plate.

52. The apparatus of claim 50 including a calculation function to estimate said known initial surface profile increment using a curve fit.

53. The apparatus of claim 52 wherein the calculation function comprises a calculation function to estimate said known initial surface profile increment using a Taylor Series curve fit.

54. The apparatus of claim 52 wherein the calculation function comprises a calculation function to estimate said known initial surface profile increment using a Fourier Series curve fit.

55. The apparatus of claim 50 wherein the known initial surface profile increment is measured using an actuator to rotate the measurement device such that one non-contact sensor is lowered relative to another while measurements are taken.

56. The apparatus of claim 55 also comprising a calculation function for calculating coordinates of the surface profile associated with a rear non-contact sensor as $$x_1^n = x_1^{n-1} + (h_1^{n-1} + l)\sin\theta^{n-1} + (h_1^n + l)\sin\theta^n + \frac{1}{2}d(\cos\theta^{n-1} - \cos\theta^n)$$

$$y_1^n = y_1^{n-1} + (h_1^{n-1} + l)\cos\theta^{n-1} + (h_1^n + l)\cos\theta^n + \frac{1}{2}d(\cos\theta^{n-1} - \cos\theta^n)$$

and coordinates of the surface profile associated with a front non-contact sensor as $$x_2^n = x_1^n + (h_2^n - h_1^n)\sin\theta^n + d\cos\theta^n$$

$$y_2^n = y_1^n + (h_2^n - h_1^n)\cos\theta^n + d\sin\theta^n$$

where n denotes values from a present sensor assembly location, n−1 denotes values from a previous location, Δs is a distance traveled, θ is the angle of a line connecting said non-contact, wave reflecting sensors, and h is the distance between the non-contact, wave reflecting sensors and the surface, l is a distance between the non-contact, wave reflective sensors and a beam on which the non-contact, wave reflective sensors are mounted, and d is the distance between the non-contact, wave reflective sensors.

57. The apparatus of claim 30 additionally comprising means for measuring a surface elevation profile of the paved surface comprising uncured paving material.

58. The apparatus of claim 57 further comprising memory for recording the surface elevation profile.

59. The apparatus of claim 57 wherein the means for modifying the paved surface elevation profile comprises means for modifying the paved surface elevation profile before the uncured paving material has cured.

60. The apparatus of claim 57 wherein the means for measuring a surface elevation profile of the paved surface comprises means for measuring a surface elevation profile of uncured concrete.

61. The apparatus of claim 60 wherein the measuring means also records the surface elevation.

* * * * *